United States Patent [19]

Winfree, Jr.

[11] 4,103,780

[45] Aug. 1, 1978

[54] BILLIARDS CUE HOLDER

[76] Inventor: John W. Winfree, Jr., 1502 S. Virginia St., Hopkinsville, Ky. 42240

[21] Appl. No.: 816,544

[22] Filed: Jul. 18, 1977

Related U.S. Application Data

[62] Division of Ser. No. 639,895, May 19, 1976, Pat. No. 4,079,839.

[51] Int. Cl.[2] ..... A47F 5/00

[52] U.S. Cl. ..... 211/68; 248/309 R

[58] Field of Search ..... 248/110, 111, 113, 315, 248/312, 316 R, 309; 224/5 B, 7 A; 211/68, 66, 89, 65, 60 T; 24/3 M, 11 F, 265 AL, 135, 115 G; 403/347, 373

[56] References Cited

U.S. PATENT DOCUMENTS

| | | | |
|---|---|---|---|
| 824,149 | 6/1906 | Ruddell | 211/68 |
| 1,213,645 | 1/1917 | Holden | 24/263 |
| 1,240,705 | 9/1917 | Grode | 211/68 |
| 3,133,719 | 5/1964 | Beck | 248/316 R X |

FOREIGN PATENT DOCUMENTS

| | | | |
|---|---|---|---|
| 49,112 | 4/1889 | Fed. Rep. of Germany | 211/68 |
| 12,560 | 10/1896 | Switzerland | 211/68 |

*Primary Examiner*—J. Franklin Foss
*Attorney, Agent, or Firm*—Harrington A. Lackey

[57] ABSTRACT

A billiards cue holder having a fixed jaw element and a movable jaw element threadedly secured to the fixed jaw element for gripping the tip portion of a billiard cue and freely suspending the cue from the holder.

2 Claims, 3 Drawing Figures

BILLIARDS CUE HOLDER

CROSS-REFERENCE TO RELATED APPLICATION

This is a division of application Ser. No. 639,895, filed May 19, 1976 now U.S. Pat. No. 4,079,839, issue date 3-21-78.

BACKGROUND OF THE INVENTION

This invention relates to a billiards cue holder and more particularly to a holder for freely suspending the cue by its tip portion.

Most billiards cue holders are in the form of racks having a base upon which the butt of each cue rests for supporting the weight of the cue. Such racks are also provided with grooves, recesses or other types of keepers for supporting the upper portions of the cues against lateral movement.

One type of holder or support for suspending a billiards cue by its tip end portion is disclosed in the German Muerer U.S. Pat. No. 49,112 (1889). The German Pat. No. 49,112, also discloses a base or butt-type support rack for a billiards cue.

SUMMARY OF THE INVENTION

It is an object of this invention to provide a billiards cue holder of novel construction particularly adapted to freely suspend the billiards cue by its tip end portion.

When a billiards cue is freely suspended and held only by its tip end portion, the entire weight of the cue tends to maintain the cue in a truly vertical position. The weight of the freely suspended cue is therefore constantly acting to stretch the grains of the wood downward, and thereby maintain the cue in a straight and true condition.

The cue holder made in accordance with this invention includes a fixed jaw element and a movable jaw element disposed upon opposite sides of the tip portion of the cue in operative position. The jaw elements are in threaded relation with each other so that the movable jaw element may be positively moved relative to the fixed jaw element. Moreover, the movable jaw element may be moved in small continuously gradual increments in order to apply the proper holding pressure upon the tip portion of the cue, tight enough to hold the cue, yet not so excessively tight that the tip portion of the cue is damaged.

Specifically, the holder includes a cylindrical body member mounted at one end to a support or wall surface in an elevated position in which the holder is spaced above the floor a distance greater than the length of the cue. The cylindrical axis of the body member is preferably maintained horizontal, projecting outward from the wall. A hole is formed in the bottom of the body member slightly larger than the diameter of the tip portion of the cue for receiving the same. The outer end portion of the body member is externally threaded. The external threads extend inwardly far enough to overlap a portion of the hole. An internally threaded movable jaw element, such as an annular cap, threadedly engages the externally threaded portion of the body member. The cap terminates in an annular inner jaw face substantially normal to the rotary axis of the cap. Thus, when the tip portion of the cue is projected upward into the over-sized hole, the annular cap member may be turned inwardly until the jaw face engages one side of the tip portion of the cue forcing it against the opposite fixed side of the hole, thereby squeezing and gripping the tip portion to suspend the cue freely from the body member.

DESCRIPTION OF THE PREFERRED EMBODIMENT

Figure 2:
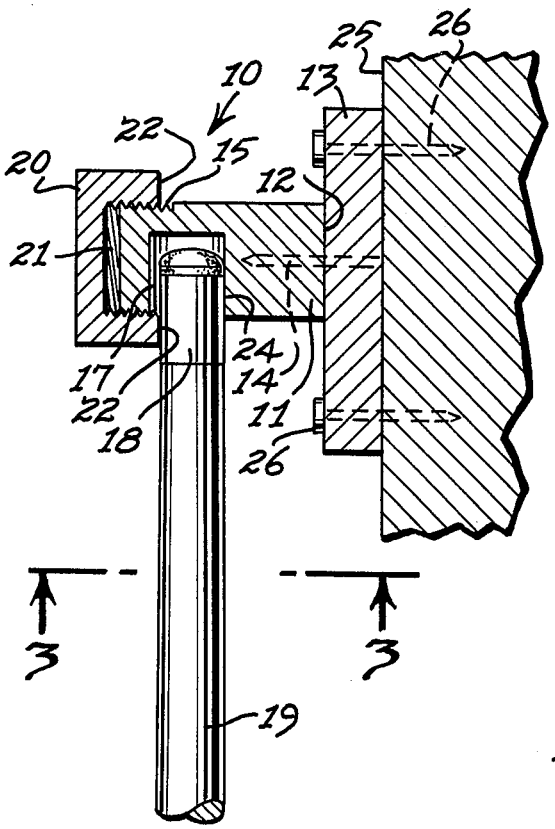
FIG. 2 is a fragmentary section taken along the line 2—2 of FIG. 1 disclosing the mounting plate fixed to the elevated surface of a wall, shown fragmentarily.

Referring now to the drawings in more detail, the holder 10 preferably includes an elongated body member 11 having a cylindrical outer surface. The inner end 12 of the body member 11 is fixed to a support or base member 13 by means of fasteners, such as the nails 14.

The outer end portion 15 of the body member 11 is externally threaded. Formed in the bottom of the body member 11 and extending upward therethrough is a substantially cylindrical hole 17 having a diameter slightly larger than the diameter of the tip portion 18 of a billiards cue 19, so that the tip portion of the cue 18 may be freely inserted into the hole 17 from the bottom of the body member 11.

A cylindrical cap 20 having an internally threaded recess 21 is adapted to fit over, threadedly engage, and receive the outer externally threaded end portion 15 of the body member 11, as disclosed in the drawings.

The inner end of the cap member 20 forms an annular jaw face 22 in a plane substantially normal to the rotary axis of the cap member 20.

It is an important feature of this invention, that the end portion 15 overlap the hole 17, at least to an extent which will permit the cap 20 to be turned and moved inward until the movable jaw face 22 will firmly engage one side of the tip portion 18, while forcing the opposite side of the tip portion 18 into frictional engagement with the opposite or inner side 24 of the hole 17.

Thus, the inner side 24 of the hole 17 functions as a fixed jaw element, while the portion of the jaw face 22 engaging the opposite side of the tip portion 18 functions as a movable jaw element for squeezing or gripping opposite sides of the tip portion 18.

The support member or mounting board 13 is fixed to the surface of the wall 25 of a room in which the cue 19 is to be stored, by fastener means, such as the nails 26. The mounting board 13 is fixed at an elevated position upon the wall 25 so that the body member 11 is spaced above the floor of the room, not shown, at a height greater than the length of the cue 19. In this manner, the holder 10 supports the cue 19 only at the tip end portion 18 by the jaws 22 and 24, so that the cue 19 is freely suspended in mid-air. Thus, the weight of the cue 19 will maintain the cue 19 in a truly vertical straight attitude.

Furthermore, the pressure exerted upon the tip portion 18 by the opposite jaws 24 and 22 may be infinitely varied because of the threaded relationship between the cap member 20 and the body member 11. By thus controlling the pressure of the jaws against the tip portion 18, only the desired amount of pressure needed to support the cue 19 may be applied, without exerting excessive or damaging pressure.

Once the cap member 20 has been turned so that the movable jaw face 22 engages the tip portion 18 with the desired amount of pressure for holding the cue 19 in a freely suspended position, the jaw face 22 remains in that position until the cap member 20 is manually counter-rotated to move the movable jaw face 22 away from the fixed jaw face 24. Thus, because the movable jaw face 22 is threadedly secured through the body member 11 to the fixed jaw face 24, slipping of the cue 19 from the holder 10 is minimized because of the unyielding nature of the jaws 22 and 24 and the maintenance of the jaws together by virtue of the substantial frictional engaging surfaces between the cooperating threads of the recess 21 and the outer end portion 15.

Figure 3:
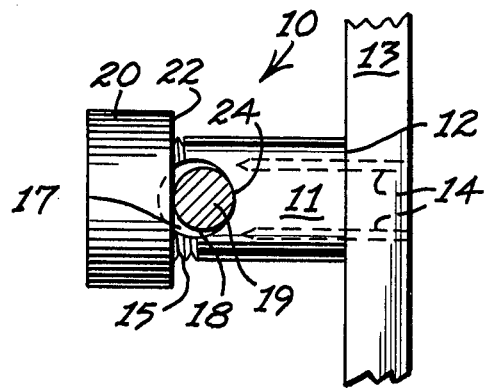
FIG. 3 is a fragmentary section taken along the line 3—3 of FIG. 2.
Figure 1:
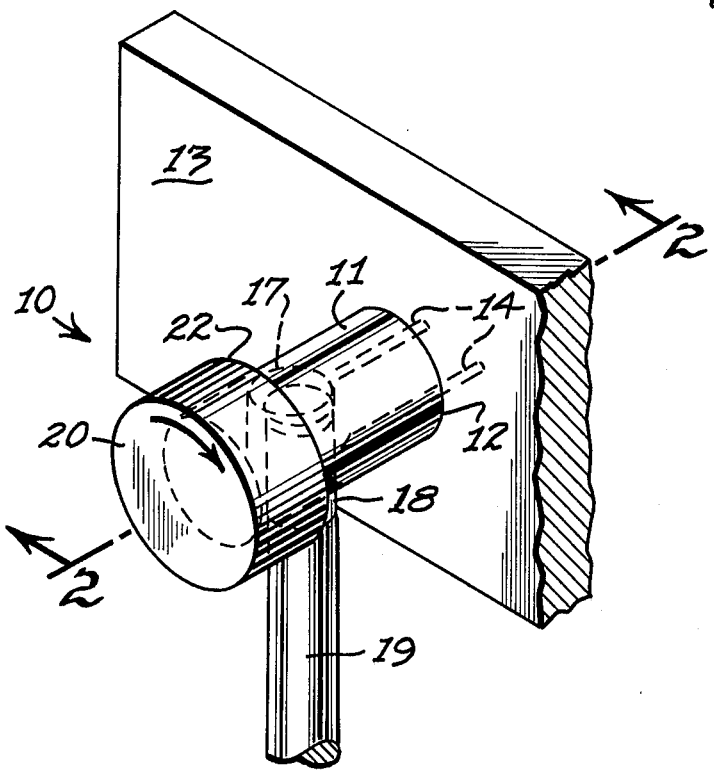
FIG. 1 is a top, front perspective view of the holder made in accordance with this invention in operative position suspending the tip portion of a billiards cue, disclosed fragmentarily.

It will be noted that the fixed jaw face 24 has substantially the same arcuate contour as the circumference of the tip portion 18, except that the fixed jaw face 24 has a slightly larger radius, as best disclosed in FIG. 3. Thus, as the movable jaw face 22 moves toward the fixed jaw face 24, the tip portion 18 will be automatically centered and held against the portion of the fixed surface 24 diametrically opposed to the movable jaw face 22, thus further assuring a more firm and stable grip upon the cue tip portion 18.

What is claimed is:

1. A holder for a billiards cue having a tip portion, comprising:

(a) a body member comprising a bottom portion and a vertical hole in said bottom portion having a diameter slightly larger than a cue tip portion, one side of said hole defining a fixed jaw element adapted to engage one side of the tip portion of said cue in a position suspended from said body member, (b) said body member further comprising an externally threaded, cylindrical end portion, including the opposite side of said hole, (c) a movable jaw element having an internally threaded portion receiving and threadedly engaging said cylindrical end portion for threaded movement toward and away from said fixed jaw element, (d) said movable jaw element having an annular jaw face in a plane substantially normal to the rotary threaded axis of said movable jaw element, said jaw face being movable across said hole to squeeze the cue tip portion against said fixed jaw element in a suspended position, (e) support means adapted to mount said body member at a predetermined elevation to provide the sole means of support of the cue in said suspended position.

2. The invention according to claim 1 in which said body member has an inner end portion, said support means being adapted to mount the inner end portion in said suspended position.

* * * * *